United States Patent [19]

Long

[11] Patent Number: 4,648,596

[45] Date of Patent: Mar. 10, 1987

[54] FOOTBALL PLACE KICKING APPARATUS AND METHOD

[76] Inventor: Donald Long, 519 N. Main Ave., Maiden, N.C. 28658

[21] Appl. No.: 430,740

[22] Filed: Sep. 30, 1982

[51] Int. Cl.[4] ..... A63B 67/00

[52] U.S. Cl. ..... 273/55 B; 124/48

[58] Field of Search ..... 273/55 B, 201, 55 R; 124/51 R, 50, 48

[56] References Cited

U.S. PATENT DOCUMENTS

| | | | |
|---|---|---|---|
| 3,262,439 | 7/1966 | Johns | 124/50 X |
| 3,738,662 | 6/1973 | Hodgin | 273/201 |
| 4,299,383 | 11/1981 | Yuasa | 124/50 X |

*Primary Examiner*—Richard C. Pinkham
*Assistant Examiner*—T. Brown
*Attorney, Agent, or Firm*—Griffin, Branigan & Butler

[57] ABSTRACT

A football place kicking apparatus having a rotatable hopper for releasably retaining a plurality of footballs with a motor for rotating the hopper for presenting a football to a mechanism for grasping a football from the football supporting hopper, one at a time, and removing the football from the hopper and displacing it along a directed path of travel to a lowered position adjacent to the apparatus for place kicking the football while it is held by the grasping mechanism. After the football is kicked, a new cycle is begun by returning the grasping mechanism to its original position for grasping another football from the hopper. The new cycle is completed when the grasped football is moved to the place kicking position and kicked. An electrical circuit is energized by a foot-actuated switch to operate the hopper motor and to operate the football grasping mechanism.

11 Claims, 7 Drawing Figures

FOOTBALL PLACE KICKING APPARATUS AND METHOD

BACKGROUND AND OBJECTIVES OF THE PRESENT INVENTION

The game of football has experienced significant modifications through the years and the art of place kicking for field goals and extra points after touchdown has become highly specialized and plays a significant role in virtually every contest. Whether in precollege, collegiate or professional football games, place kicking has become highly specialized to the point where individual players concentrate solely upon this phase of the game.

Individual players who specialize in place kicking normally require another person to assist during practice for holding the football while the place kicker kicks the held football. Practice sessions may last for hours and the place kicking specialist may become dependent upon having another person available always for holding the football during practice sessions.

It is an objective of the present invention to provide an apparatus and method for storing a plurality of footballs in a conveniently located hopper and sequentially remove individual footballs and position them in a predetermined position adjacent to the ground readily accessible automatically for place kicking by a place kicker.

Another objective of the present invention is to provide an apparatus that is portable and may be readily moved by one individual who may load a number of footballs into a hopper and remotely actuate the hopper and a mechanism for removing a football from the hopper and positioning the football to a place kicking position without assistance from others.

Still another objective of the present invention is the provision of a self-contained automated football place kicking apparatus in which a football may be withdrawn from a stored position and placed in a kicking position automatically and continuously enabling a place kicking specialist to function independently of others in practice sessions.

Other objectives and many of the attendant advantages of this football place kicking apparatus and method will become readily apparent to football players, athletic directors and coaches from the following detailed description taken in conjunction with the accompanying drawings and the appended claims in which mechanical equivalents and variations are contemplated therein.

SUMMARY OF THE INVENTION

A football place kick positioning apparatus mounted on a mobile base frame in which a rotatable football-supporting hopper is mounted on the frame and will support a series of footballs in a predetermined position by releasably supporting them. A football grasping mechanism automatically removes a football from the football supporting hopper and displaces the football along a directed path of travel from the football supporting hopper to a lowered position on the ground spaced from the apparatus and held in a suitable position for place kicking. The football grasping means will be returned automatically to grasp another football for another cycle by actuating a mechanism for activating the football grasping means again for another cycle.

BRIEF DESCRIPTION OF DRAWINGS FOR THE PREFERRED EMBODIMENT OF THE INVENTION

DETAILED DESCRIPTION OF A PREFERRED EMBODIMENT OF THE INVENTION

Figure 1:
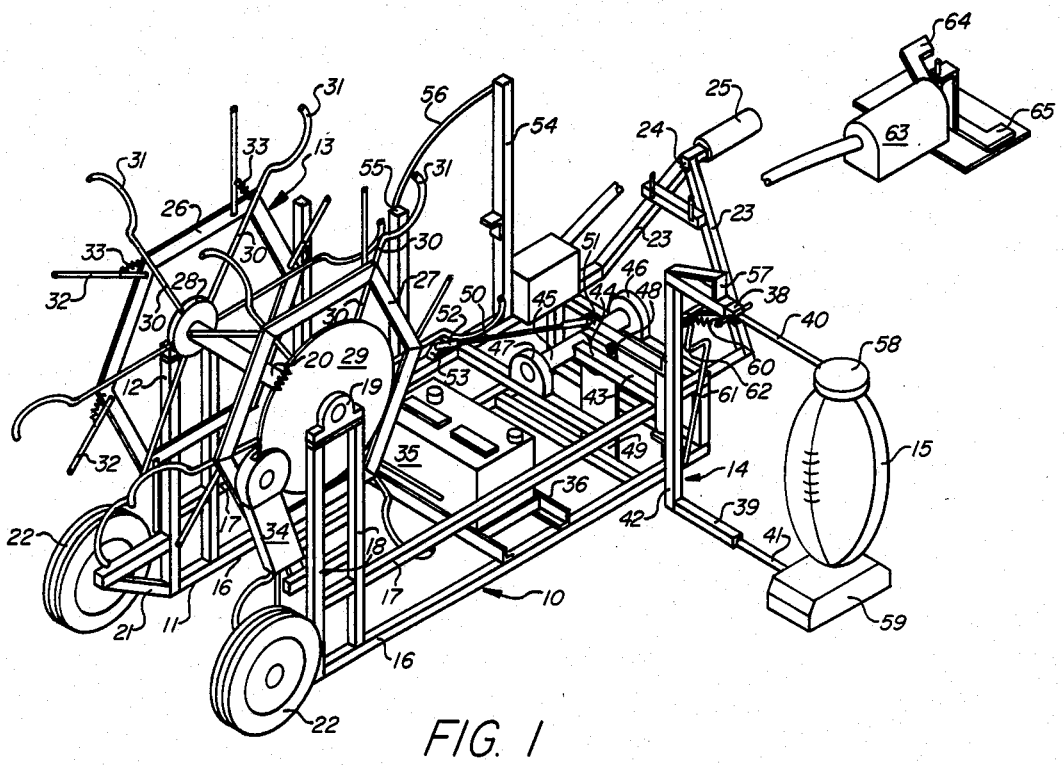
FIG. 1 is a side perspective view of a football place kick positioning apparatus, with portions removed, and a football supported in the place kicking positions.

Referring to the drawings and particularly to FIG. 1, there is illustrated a mobile football place kicking apparatus 10 having a base frame 11 and a superstructure 12 for rotatably supporting a football-retaining hopper 13 for releasably supporting a plurality of footballs for presentation to a football grasping and positioning mechanism 14 for removing a football from the football supporting ferris wheel or football retaining means 13 and positioning the football 15 to the place kicking position shown in FIG. 1 as the football grasping and positioning means 14 travels from football removing and grasping position adjacent to the football retaining hopper through a predetermined directed path of travel to the place kicking position illustrated in FIG. 1.

The base frame 11 is constructed of square tubing with an undercarriage longitudinally extending beam 16 at each side of the apparatus and an upper reinforcing beam 17 vertically spaced above the lower beam 16. A pair of laterally spaced and vertically extending members 18 is vertically supported on the base frame 16 at each side of the frame and supports a bearing pillow block 19 for cooperatively receiving and supporting shaft 20 therein for rotation of the hopper 13.

The forward section of the base frame 10 is provided with forwardly projecting wheel-supporting members 21 to which a wheel 22 is bearingly mounted for mobility of the apparatus by an individual. An upwardly converging pair of supporting arms 23 is secured to the upper rail 17 and converges at the apex 24 of the angle at which position a guiding and lifting handle 25 is secured enabling an individual to lift the rear end of the apparatus to push or pull the apparatus to the desired location. Alternatively, the apparatus may be hooked to a towing apparatus and moved from one location to another.

The football retaining hopper 13 is provided with laterally spaced hexagonally shaped frame members 26 and 27 which are retained in position from the hub 28 and gear 29 by means of the radially projecting football retaining arms that are uniformly spaced from each other and each is provided with a terminal football-retaining hook member so that a football 15 may be cradled in the spaced football-retaining hook members 31 during rotation of the ferris wheel football supporting member 13. A series of pivot arms 32 is associated with each football-retaining hook member 31 and is urged to engage and retain a football in position by means of the helical spring 33 which urges each of the members 32 into engagement with a football when the football is positioned on the football engaging arcuate member 31 by displacing the spring urged members 32.

A motorized gear drive mechanism 34 is mounted on the base frame 10 and is provided with a driving gear (not shown) for driving the hopper or ferris wheel gear 29 for rotation of the hopper 13. The electrical energy for driving the gear motor 34 is obtained from the storage battery 35 that is mounted on the battery frame 36 which is supported on the base frame 10 permitting the apparatus to be self-contained and portable and capable of being operated on its own power supply. Upon rotation of the rotatable football-supporting hopper 13, footballs positioned in the hopper at the spaced locations will travel in a directed path of travel and may be stopped individually at a particular location, if preferable, so that a football may be removed readily by overcoming the biasing action of the spring actuated rod members 32.

Figure 3:
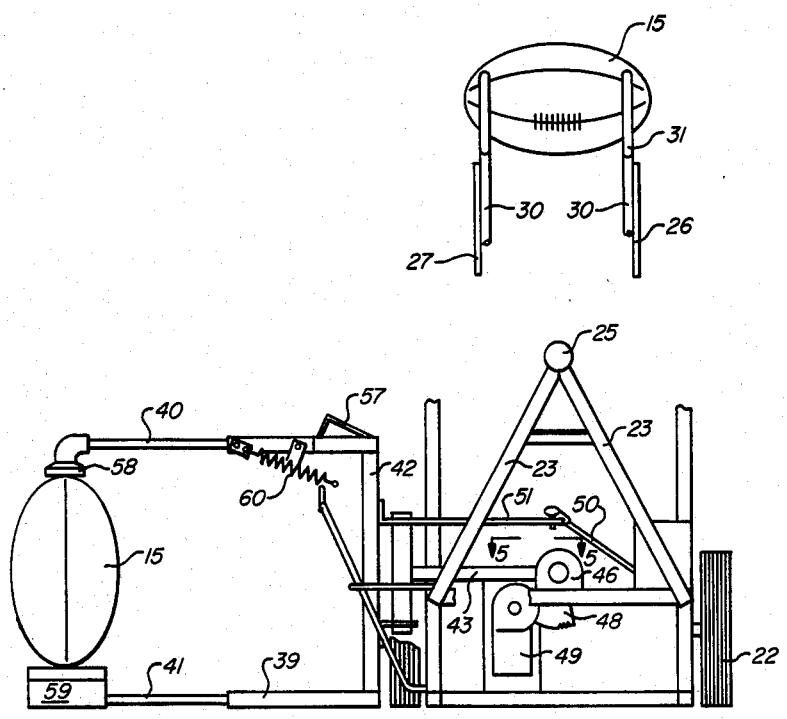
FIG. 3 is a partial rear end view of FIG. 1 illustrating one football in the football-supporting hopper and another football in the place kicking position.
Figure 4:
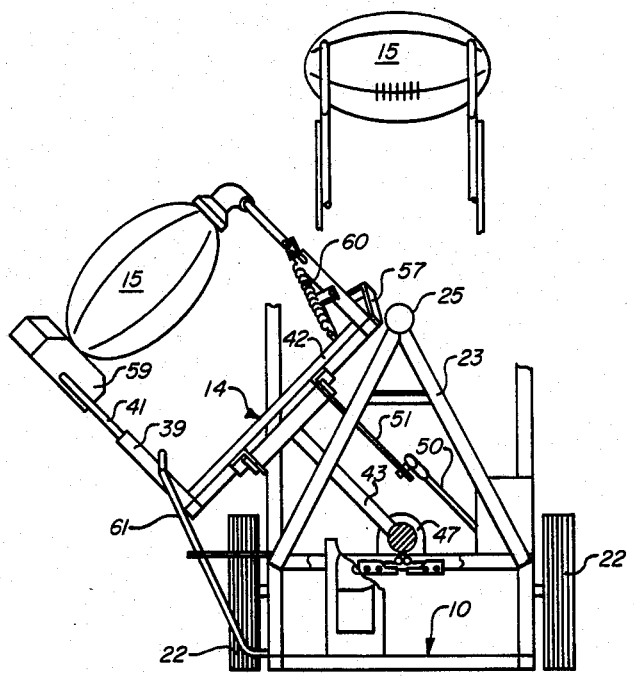
FIG. 4 is a partial rear end view of FIG. 1 with the football grasping and positioning mechanism holding a football in an intermediate position before the football is placed in the kicking position illustrated in FIG. 3.

The football grasping and removing mechanism 14 is provided with a pair of spaced football-engaging arms 38 and 39, each of which may be adjusted by the telescoping sections 40 and 41 which may be suitably clamped in position for the desired orientation of the football. The arms 38 and 39 extend from the crossbar or yoke 42 which is securely fastened to the actuating arm 43 which has its end 44 welded to the shaft 45 that is mounted in the bearings 46 and 47 that are supported on crossbars secured to the base frame and on which shaft 45 a gear segment 48 is secured to be driven by a gear motor 49 also mounted and supported on the base frame 10. An adjustable guide arm 50 is secured to a projecting link 51 extending from the cross arm 42 at one end and the other end 52 of the control arm 50 being pivotally secured to a socket 53 on the base frame for controlling the displacement of the football grasping and displacing mechanism 14. A vertical post 54 is securely mounted on the base frame member 17 in spaced parallel relation to the vertical member 55 which is also supported on the base frame 17 for retaining thereon the arcuate cam guide rod 56 for controlling the guidance of the football grasping and displacing means 14 for a portion of its predetermined directed path of travel after grasping a football from the hopper from the horizontal football position to a rotating position by means of the rotation of shaft 45 through gear 48 and gear motor 49 to pivot the football grasping and displacing mechanism 14 in a substantially vertical plane as shown in FIGS. 3 and 4 to place the football 15 in the place kicking position adjacent to the ground readily accessible to the kicker. A cam follower 57 is mounted on the arm 38 for engaging the arcuate rod or cam 56 during initial guided displacement of the football grasping mechanism upon withdrawing a football from the football supporting hopper 13 which cam follower 57 will be disengaged when the rotation of shaft 45 occurs.

The football 15 will be engaged by a top positioning pad 58 mounted on extension arm 40 and a ground engaging and positioning pad 59 will support the football on the ground at an appropriate angle and elevation depending upon the desired inclination and orientation of each individual kicker with the pad 59 being secured to the arm 41. A spring member 60 is connected to the arm 38 and cross arm member 42 through appropriate connecting members to urge the arm 40 and pad 58 into releasable engagement with the football and to provide needed displacement for arm 40 to permit ease of release of the football 15 from engagement between pads 58 and 59 when the football is kicked.

A vertically extending guide rod 61 having a guide hook 62 thereon is secured to the base frame for engaging and retarding momentarily the return of the football grasping means from the lowered position as shown in FIG. 1 to its vertical and retracted position adjacent to the football supporting hopper 13 for commencement of another cycle.

Figure 6:
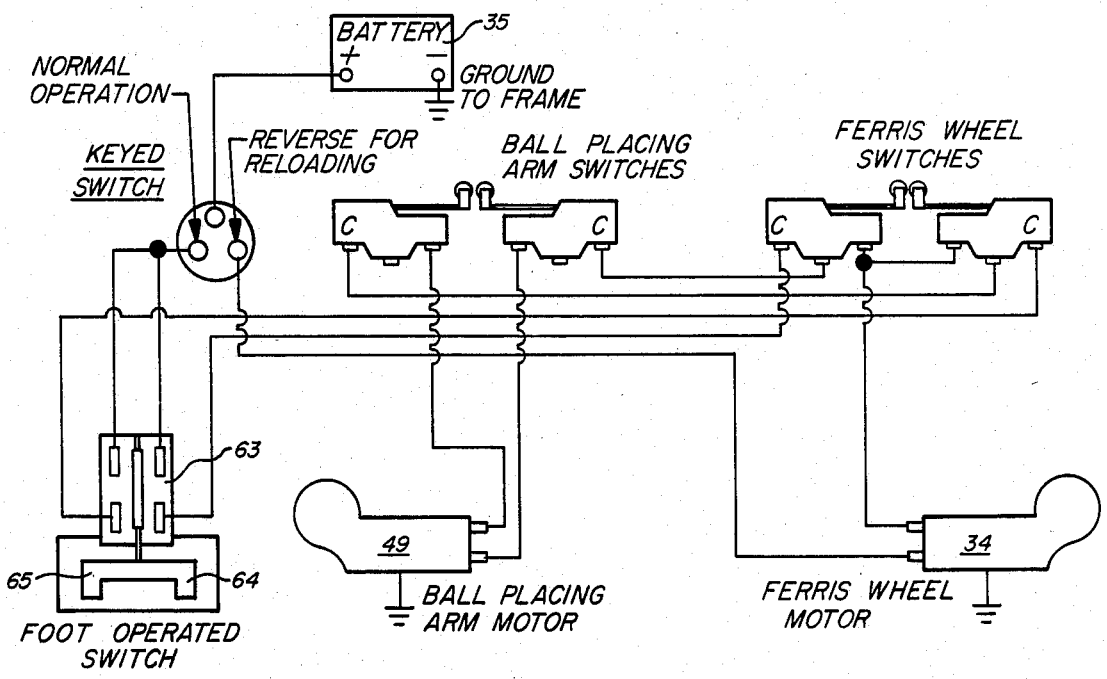
FIG. 6 is a schematic electrical diagram of a battery operated football place kicking apparatus.

A foot operated switch 63 having pivotable foot-engaging pedals 64 and 65 will control the actuation of the football supporting hopper rotation and the displacement of the football grasping and displacing mechanism 14 as illustrated in the electrical schematic diagram in FIG. 6 to be described hereafter.

Figure 2:
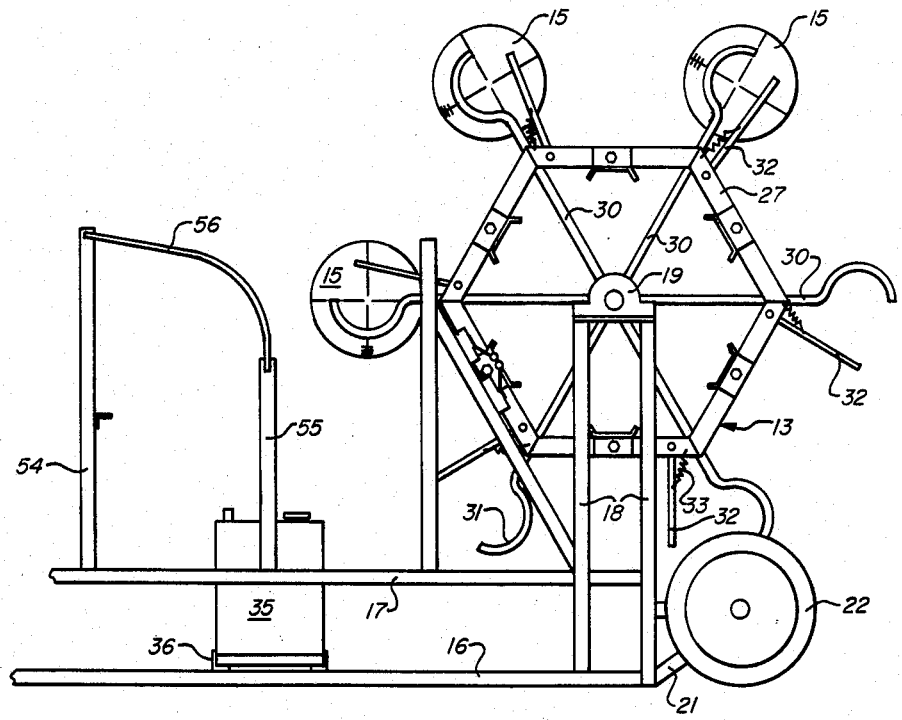
FIG. 2 is a partial side view of a rotating football-supporting hopper with several footballs releasably mounted in the hopper.
Figure 5:
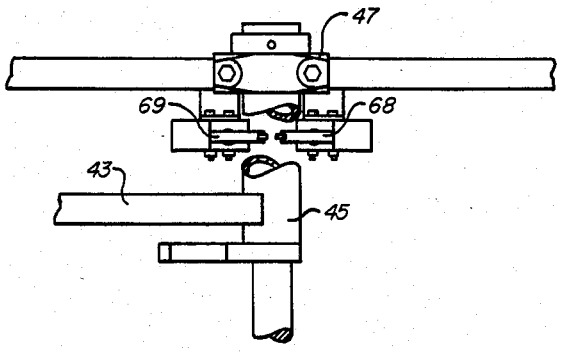
FIG. 5 is an enlarged partial plan view, with portions removed, taken along the line 5—5 of FIG. 3.

There is illustrated in FIG. 2 the football-retaining hopper in which several footballs 15 are releasably retained in position with three of the football-retaining positions having the footballs removed. The football 15 at the left in the football-retaining hopper 13 is in a position for removal by the football grasping and displacing means 14 by having the pads 58 and 59 engage opposite ends of the football for removal by withdrawing the football laterally and pivoting the arm 32 against the biasing action of spring 33. The football positioning cycle of withdrawing the football 15 from the football retaining hopper 13 and displacing the football along a directed path of travel by means of the football grasping and displacing means 14 is illustrated in FIG. 3 in which the football is positioned adjacent to the ground preparatory for kicking by being supported between the pads 58 and 59 mounted on the movable arms 40 and 41. An intermediate position for the displacement of the football 15 by the grasping and displacing means 14 is illustrated in FIG. 4. FIG. 5 illustrates a portion of the mechanism, with sections removed, for the displacement of the football grasping and displacing means in which the oscillatable shaft 45 is supported in suitable bearing blocks 46 and 45 (FIG. 1) with the spaced gear segments 68 and 69 being shown in the disengaged position below the portion of the removed section of shaft 45 which shaft retains the arm 43 for pivoting the football grasping and displacing means 14.

Figure 7:
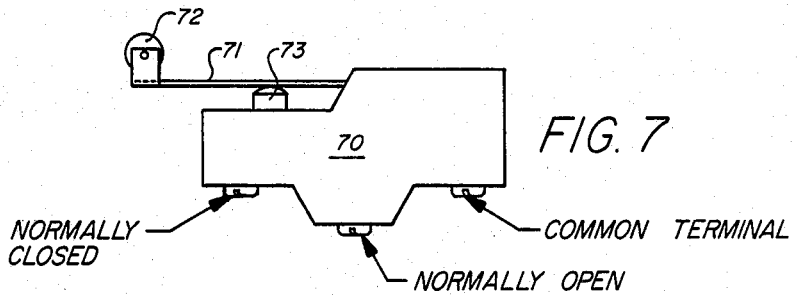
FIG. 7 is a plan view of a snap action lever switch.

A micro-switch 70 is illustrated in FIG. 7 in which the sensing arm 71 is pivotally connected in the housing and has a contact roller 72 mounted at the terminal end for engaging the component to be engaged for actuating or deactuating a particular mechanism for depressing the plunger 73 mounted in the switch on which the common terminal and the normally open and normally closed terminals are illustrated.

The schematic electrical system is shown in FIG. 6 with the micro-switches for the ferris wheel displacement and stoppage in the cycle to present a ball in the position shown in FIG. 2 at each partial rotation by engaging the micro-switches for start and stop through actuation of the foot operated switch and for actuating the ball placing arm motor which is the ball grasping and displacing means through its micro-switches.

As will be readily apparent, in the method of automatically positioning a football for place kicking, the football is stored releasably in the football-supporting hopper 13 in which the football 15 is positioned for removal. The football is grasped by the grasping and displacing means 14 from the hopper in the removal position and the football is displaced along a predetermined directed path of travel from the football removal position in the hopper to a ground place kicking position so that the football may be place kicked by a kicker.

I claim:

1. A football place kick positioning apparatus comprising a base frame, a football-supporting hopper mounted on said frame, said football-supporting hopper having means for releasably supporting at least one football, means for grasping said football at opposite ends thereof and removing it from said hopper and displacing said football along a directed path of travel to a lowered position for place kicking while supporting said football in a substantially vertical position at opposite ends thereof by said football grasping means.

2. A football place kick positioning apparatus as claimed in claim 1, said football-supporting hopper being rotatable for supporting a plurality of footballs in spaced relation to each other.

3. A football place kick positioning apparatus as claimed in claim 1, said football-supporting hopper having a plurality of football-retaining positions, each football retaining position in said hopper having a football-retaining means and a releasable football clamping means, said grasping and displacing means having a pair of spaced football-retaining arms, each of said arms having a football-engaging and positioning pad, and means for guiding said football retaining arms in a directed path of travel from a position grasping a football and removing it from said football hopper to a ground-engaging position by one of said football-engaging and positioning pads.

4. A football place kick positioning apparatus as claimed in claim 1, means for rotating said football-supporting hopper for presenting a football to said football grasping and displacing means.

5. A football place kick positioning apparatus as claimed in claim 4, said football grasping means having laterally spaced football-retaining arms, means on said frame for engaging and guiding the displacement of said football-retaining arms along at least a portion of said directed path of travel, and means for guidably displacing said football-retaining arms for the balance of its directed path of travel to the football place kicking position.

6. A football place kick positioning apparatus as claimed in claim 1, motorized means for rotating said football supporting hopper, and motorized means for displacing said football grasping and displacing means.

7. A football place kick positioning apparatus as claimed in claim 1, said base frame having at least one wheel for mobilizing said apparatus.

8. A football place kick positioning apparatus as claimed in claim 1, motorized means for rotating said football supporting hopper, motorized means for displacing said football grasping and displacing means, a battery for supplying electrical energy to said motorized means, and a switching mechanism for actuating and controlling the football-supporting hopper motorized means and the motorized means for displacing said football grasping and displacing means.

9. A method for automatically positioning a football for place kicking comprising the steps of releasably storing a football in a football-supporting hopper, positioning the football for removal from said hopper, grasping the football at opposite ends thereof from said hopper in said removal position, displacing said football along a predetermined directed path of travel from the football removal position at said hopper to a ground place kicking position while continuing to grasp opposite ends of the football whereby the football may be place kicked by a kicker.

10. A football place kick positioning apparatus comprising a base frame, a football-supporting holder mounted on said frame, said football-supporting holder having means for releasably supporting at least one football, means for grasping said football at opposite ends thereof and removing it from said holder and displacing said football along a directed path of travel to a position for place kicking while supporting said football in a substantially vertical position at opposite ends thereof by said football grasping means.

11. A method for automatically positioning a football for place kicking comprising the steps of releasably storing a football in a football-supporting holder, positioning the football for removal from said holder, grasping the football at opposite ends thereof from said holder in said removal position, displacing said football along a predetermined directed path of travel from the football removal position at said holder to a ground place kicking position while continuing to grasp opposite ends of the football whereby the football may be place kicked by a kicker.

* * * * *